US012342919B1

(12) United States Patent
Vecchiola et al.

(10) Patent No.: US 12,342,919 B1
(45) Date of Patent: Jul. 1, 2025

(54) INTERACTIVE STYLING HAIRBRUSH

(71) Applicants: Michael Victor Vecchiola, Toronto (CA); Patricia M. Coyne, Toronto (CA)

(72) Inventors: Michael Victor Vecchiola, Toronto (CA); Patricia M. Coyne, Toronto (CA)

( * ) Notice: Subject to any disclaimer, the term of this patent is extended or adjusted under 35 U.S.C. 154(b) by 474 days.

(21) Appl. No.: 17/903,479

(22) Filed: Sep. 6, 2022

Related U.S. Application Data

(60) Provisional application No. 63/280,979, filed on Nov. 18, 2021.

(51) Int. Cl.
*A45D 20/52* (2006.01)
*A46B 9/02* (2006.01)

(52) U.S. Cl.
CPC ..... *A45D 20/525* (2013.01); *A46B 9/02* (2013.01)

(58) Field of Classification Search
CPC . A45D 2/12; A45D 2/14; A45D 2/145; A45D 20/52; A45D 20/525; A46B 9/02; A46B 9/023; A46B 9/026; A46B 15/003; A46B 2200/104
USPC ..... 15/159.1, 160
See application file for complete search history.

(56) References Cited

U.S. PATENT DOCUMENTS

| | | | | |
|---|---|---|---|---|
| 4,226,251 | A * | 10/1980 | Wall | A46B 15/00 15/159.1 |
| 4,423,531 | A * | 1/1984 | Wall | A46B 3/005 132/129 |
| 4,566,473 | A * | 1/1986 | Hyman | A46B 5/02 132/120 |
| 6,408,475 | B1 * | 6/2002 | Morrison | A46B 17/06 15/159.1 |
| 10,292,486 | B2 | 5/2019 | Vecchiola et al. | |
| 2008/0190441 | A1 * | 8/2008 | Vecchiola | A45D 24/38 132/150 |
| 2017/0035193 | A1 * | 2/2017 | Vecchiola | A46B 15/003 |

FOREIGN PATENT DOCUMENTS

| | | |
|---|---|---|
| CA | 2 206 690 C | 12/1997 |
| CA | 2 538 297 A1 | 8/2006 |

* cited by examiner

*Primary Examiner* — Eric J Rosen
*Assistant Examiner* — Aaron R McConnell
(74) *Attorney, Agent, or Firm* — Lippes Mathias LLP

(57) ABSTRACT

A styling brush with vanes that is interactive, which directs and redirects air flow of a hair dryer, is used to improve styling techniques for right-handed or left-handed users. The bristles of the brush may be such that the user's hair floats on a cushion of bristles to speed up drying and protect the user's hair from excessive heat damage.

16 Claims, 5 Drawing Sheets

INTERACTIVE STYLING HAIRBRUSH

BACKGROUND

This application claims the priority benefit of U.S. provisional application Ser. No. 63/280,979, filed Nov. 18, 2021, the entire disclosure of which is expressly incorporated herein by reference.

The present exemplary embodiment relates to hairbrushes. It finds particular application in conjunction with and is preferably an integral component of a modified hairbrush and will be described with particular reference thereto. However, it is to be appreciated that the present exemplary embodiment is also amenable to other like applications.

Styling hairbrushes are well known. United States patents referring to such prior art systems include commonly owned U.S. Pat. Nos. 5,911,226 and 10,292,486, the entire disclosures of both of which are hereby incorporated herein by reference as though set forth fully herein, and copies are attached as an annex. In conventional hairbrushes, the hairbrush is manipulated by the stylist/user. Other than the stylist's own manipulation, air flow from a hair dryer (or sometimes referred to as a blow dryer) is dispersed in all directions on the styling hairbrush and the ability to control air flow is limited. Some hair dryers include features or attachments such as a diffuser, airflow concentrator, and nozzle attachment in an effort to provide increased control of hot and/or cool air from the hair dryer; however, the styling hairbrush has not received the same attention to improve styling and enhance control of the air flow emitted from the hair dryer. In addition, hairbrush designs have not addressed the need to reduce drying time, and/or reduce heat damage to the hair.

A need exists for a styling hairbrush that directs the air flow of a hairdryer used in association with hairstyling. Further, a need exists for a hairbrush, preferably a round hairbrush, that can be functionally different and thus used by a left-handed or right-handed user (e.g., stylist) for hairstyling. Additionally, a need exists for a styling hairbrush to be more interactive as a styling tool to create control by the brush of a hair dryer's heat and/or air flow.

SUMMARY

The present disclosure is directed to a hairbrush with functional components and features that make the hairbrush an interactive tool for use by a stylist/user when styling (a customer's hair) with a hair dryer and the hairbrush.

An exemplary embodiment of the hairbrush includes a handle and a brush head connected to the handle. The brush head has first and second axially spaced apart end portions interconnected by a central portion along an elongated axis. Bristles extend from the outer surface of the brush head, and the bristles have terminal ends spaced generally radially outward from the outer surface. Vanes extend generally radially outward from the first, enlarged end portion of the brush head. The vanes are configured to direct air flow from an associated hairdryer impinging on the hairbrush in an axial direction along the central portion toward the second, enlarged end portion of the brush head.

The central portion of the brush head in one preferred embodiment has a cross-sectional first dimension smaller than a cross-sectional second dimension of the first end portion.

The central portion of the brush head in one embodiment preferably has a cross-sectional first dimension smaller than a cross-sectional second dimension of the first end portion and a cross-sectional third dimension of the second enlarged end portion, i.e., having the general shape of a concave barrel and sometimes referred to herein as a hairbrush with captive ends.

The vanes are preferably circumferentially spaced apart and form channels therebetween.

The vanes preferably vary in radial height from the outer surface of the brush head over an axial dimension.

The radial height of the vanes preferably decreases as the vanes extend axially toward the central portion of the brush head and the vanes merge into the outer surface of the brush head, and preferably the vane height extends radially outward from the brush head particularly at the enlarged ends and merges into the outer surface of the brush head in the central portion of the concave barrel.

The bristles preferably extend from the central portion only, and the bristles are arranged in circumferentially spaced rows extending axially from the first end portion to the second end portion of the brush head.

The vanes are configured to direct air flow along the brush head between the rows of bristles. The vanes terminate in an axial direction adjacent the rows of bristles.

The bristles further include bundles of individual bristles tightly bunched together at the outer surface of the brush head and the individual bristles diverge outwardly from one another as the bristles extend radially outward from the outer surface of the brush head (typically no bristles are provided in the enlarged ends/captive ends of the brush head, although this disclosure does not preclude the inclusion of bristles in these regions of the brush head).

The hairbrush includes alternating rows of the bristles, which alternating rows have staggered axial dimensions along the central portion of the brush head.

The hairbrush further includes vanes extending radially outward from the second end portion for directing air flow, from an associated hair dryer impinging on the hairbrush, in an axial direction along the central portion toward the first end portion of the brush head. The vanes located on the first end portion preferably terminate adjacent an end of a first set of bristle rows. The vanes located on the second end portion preferably terminate adjacent an end of a second set of bristle rows, wherein the first set of bristle rows alternate with the second set of bristle rows about a circumference of the central portion of the brush head.

The handle of the hairbrush is connected to the first enlarged end portion of the brush head to form a hairbrush configured for an associated stylist/user that is right-handed.

The handle is connected to the second enlarged end portion of the brush head to form a hairbrush configured for an associated stylist/user that is left-handed.

In a preferred arrangement of the brush head of the hairbrush, the second and third dimensions of the first and second end portions are substantially the same.

The brush head of the hairbrush preferably has a concave conformation.

The brush head includes arcuate transitions from the first and second end portions into the central portion of the brush head.

The handle, neck (e.g., region between the end portion and the handle) and the brush head of the hairbrush may be formed of the same material or at least in part from different materials.

The hairbrush is configured for a transposable grip.

A method of making a hairbrush having improved styling characteristics, includes providing a handle; providing a brush head having an outer surface, a central portion, and two enlarged end portions, wherein the central portion is generally concave relative to the two enlarged end portions, and wherein the outer surface has spatially arranged vanes at least one end portion.

The method further includes providing a cushion of bristles extending between vanes proximate to the first and second end portions; and securing the handle and brush head together.

A primary advantage resides in increased control by channeling heat and air flow while styling hair with the subject hairbrush, thereby reducing drying time and the amount of heat required during the styling process.

Yet another feature is the ability to direct airflow beneath hair supported on outer ends of the bristles.

Still another benefit is associated with the ability to provide a right-hand and left-hand version of the round hairbrush.

A still further advantage resides in the ability to achieve this increased functionality without adding significant cost to the manufacture and/or to a sale price of the new hairbrush.

Still other benefits and advantages of the present disclosure will become more apparent from reading and understanding the following detailed description.

DETAILED DESCRIPTION

Figure 1:
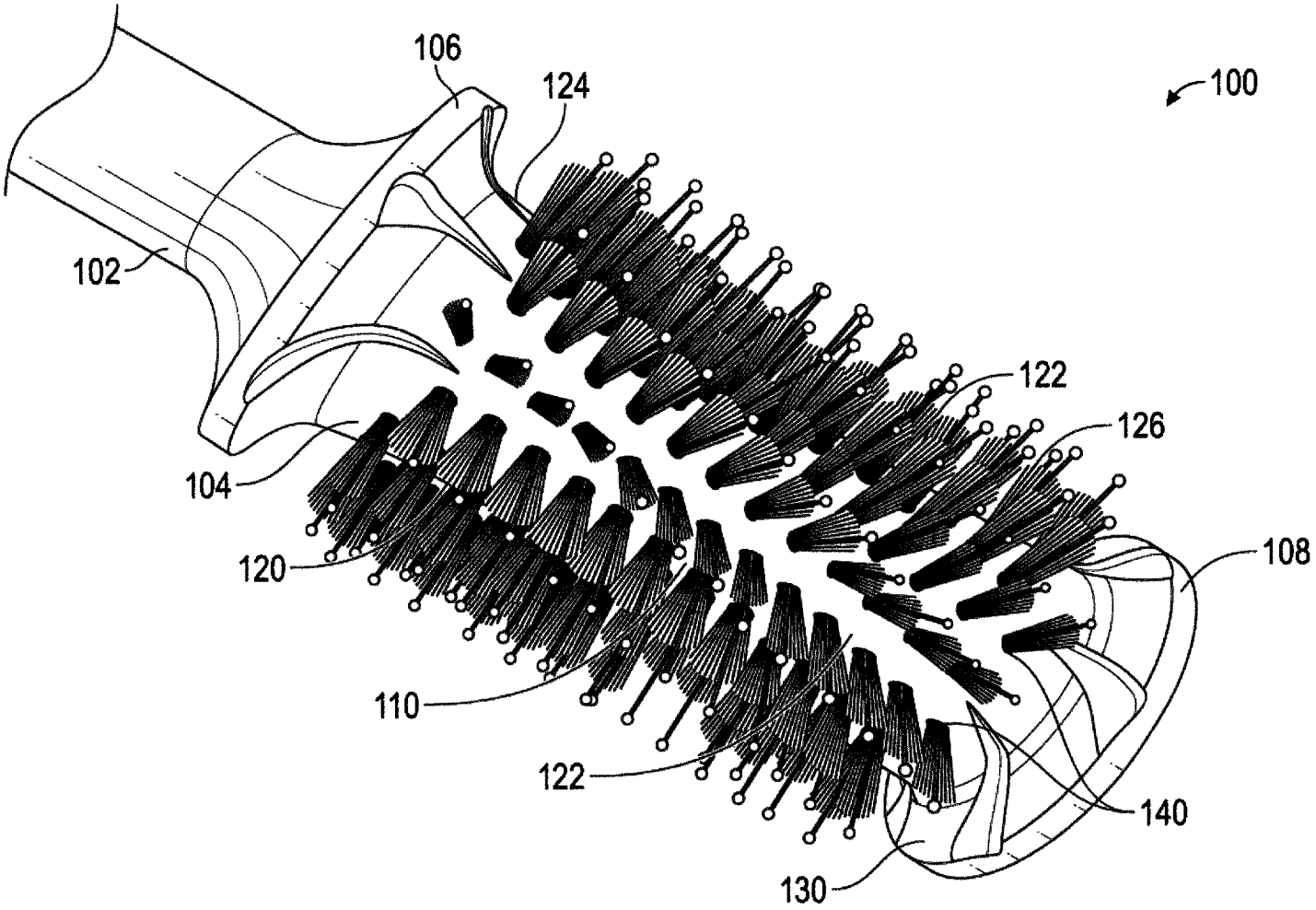
FIG. 1 shows a hairbrush and improved styling and temperature characteristics in accordance with the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases, terms, or words that require the presence of the named components/steps and permit the presence of other components/steps. However, such descriptions should be construed as also describing kits or devices or methods as "consisting of" and "consisting essentially of" the enumerated components/steps, which allows the presence of only the named components/steps, and excludes other components/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number.

The terms "upper" and "lower" are relative to each other in location, i.e. an upper component is located at a higher elevation than a lower component.

The terms "horizontal" and "vertical" are used to indicate direction relative to an absolute reference, i.e. ground level. However, these terms should not be construed to require similarly described structures to be absolutely parallel or absolutely perpendicular to each other.

Turning now to FIG. 1, there is shown a hairbrush 100 having a handle 102 (with or without a demarcated neck) that is connected to a brush head 104. In one preferred embodiment, the handle 102 includes a soft grip. However, other handle shapes and designs may be used without departing from the scope and intent of the present disclosure. In another embodiment, the handle 102 and the brush head 104 are formed at least in part from different materials. In still another embodiment, the brush head 104 includes a substrate from one of wood, metal, or plastic composition. In still another embodiment, the handle 102 and the brush head 104 may be a single, unitary body or structure.

In the illustrated embodiment, the handle 102 is connected to a first enlarged end portion 106 of the brush head 104. In another preferred embodiment, the handle 102 is connected to a second enlarged end portion 108 of the brush head 104. In still another preferred embodiment, the handle 102 is configured, alternately, for right-handed or left-handed users.

The brush head 104 of hairbrush 100 includes the axially spaced apart first and second end portions 106, 108 which are interconnected by an intermediate, central portion 110 along an elongated axis. The central portion 110 of the brush head 104 preferably has a generally concave conformation, and thus has a cross-sectional first dimension smaller than a cross-sectional second dimension of the first enlarged end portion 106, and more preferably smaller than a cross-section third dimension of the second enlarged end portion 108. The second and third dimensions of the first and second enlarged end portions 106, 108 are typically substantially the same; however, this need not always be required. The brush head 104 desirably includes arcuate transitions from the first and second end portions 106, 108 into the central portion 110 of the brush head 104, although other transitional conformations could be used.

A series of axially spaced openings 120 are provided in the brush head 104 and adapted to receive bristles 122 that extend through the outer surface 124 of the brush head 104. The bristles 122 have terminal ends 126 that extend radially outward from the outer, external surface 124 of the brush head 104. More particularly, the bristles 122 are preferably arranged in circumferentially spaced rows extending axially from the first end portion 106 to the second end portion 108 of the brush head 104. The bristles 122 in FIG. 1 are shown in circumferentially spaced rows and the rows have a helical twist, i.e., the rows rotate in the circumferential direction as the row proceeds in the axial direction from one end portion toward the other end portion; however, one skilled in the art will appreciate that still other bristle configurations can be used without departing from the scope of the present disclosure. In one preferred embodiment, the alternating rows of bristles 122 have staggered axial dimensions along the central portion 110 of the brush head 104. That is, every other row terminates at a slightly different axial location from the circumferentially adjacent row of bristles. Although the rows of bristles 122 form a helical conformation around the brush head 104, the rows could be linear or have a greater or lesser helical twist, or adopt still another pattern. The bristles 122 usually include bundles of individual bristles tightly bunched together at the outer surface 124 of the brush head 104. The individual bristles diverge outwardly from one another as the bristles 122 extend radially outward from the outer surface 124 of the brush head 104. In another embodiment, the bristles 122 extend from the central portion 110 only and thus terminate at an axial location spaced inwardly from vanes 130 to be described further below.

In one preferred embodiment, the vanes 130 extend radially outward from the first enlarged end portion 106 of the brush head 104. In another embodiment, the vanes 130 extend radially outward from the second enlarged end portion 108 of the brush head 104. In still another embodiment, vanes 130 extend radially outward from the first and second enlarged end portions 106, 108 of the brush head 104. The vanes 130 are fixed on brush head 104 such as by integrally molding the vanes as a part of the material that forms the brush head.

Figure 2:
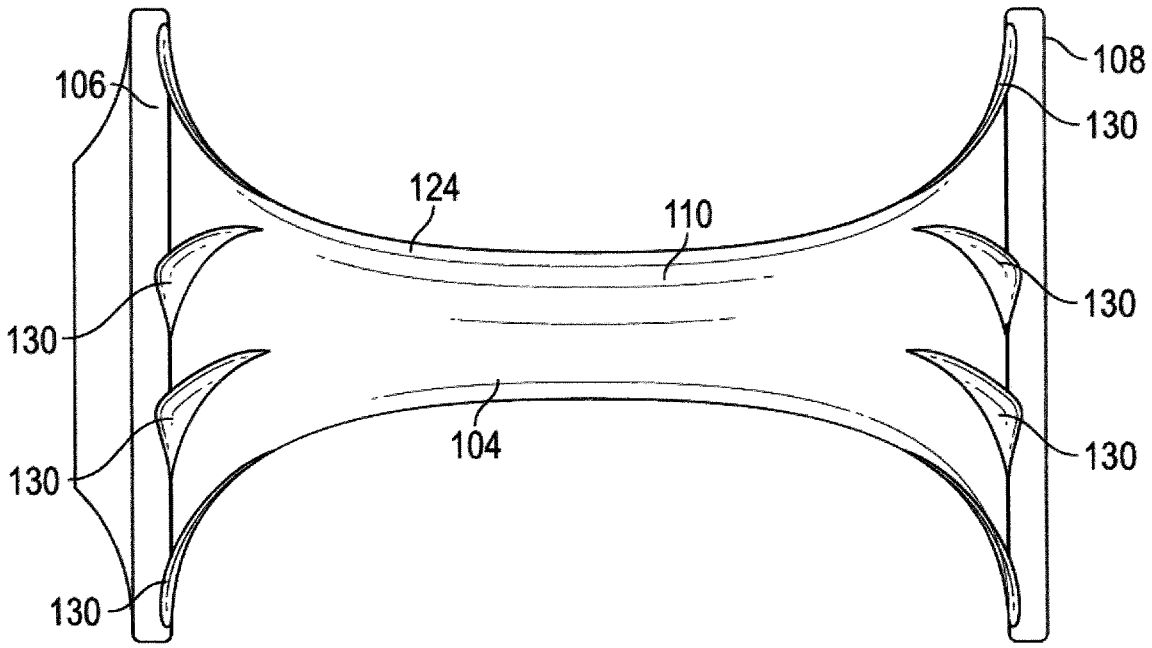
FIG. 2 is a front view of the vanes channeling the air.

In one preferred embodiment, FIGS. 1 and 2 show vanes 130 extending radially outward from the first enlarged end portion 106 of the brush head 104 that are configured to direct air flow from an associated hair dryer impinging on the hairbrush 100. The vanes direct the air flow in an axial direction along the central portion toward the second enlarged end portion 108 of the brush head. In another preferred embodiment, vanes 130 extending radially outward from the second enlarged end portion 108 of the brush head 104 are configured to direct air flow from an associated hair dryer impinging on the hairbrush 100 in an axial direction along the central portion toward the first enlarged end portion 106 of the brush head 104. The vanes 130 may be curved in shaped to direct channeling of air flow between the rows of bristles 122.

The vanes 130 are configured to direct air flow between the same row of bristles when a user holds the brush 104 in their left or right hand.

Figure 3:
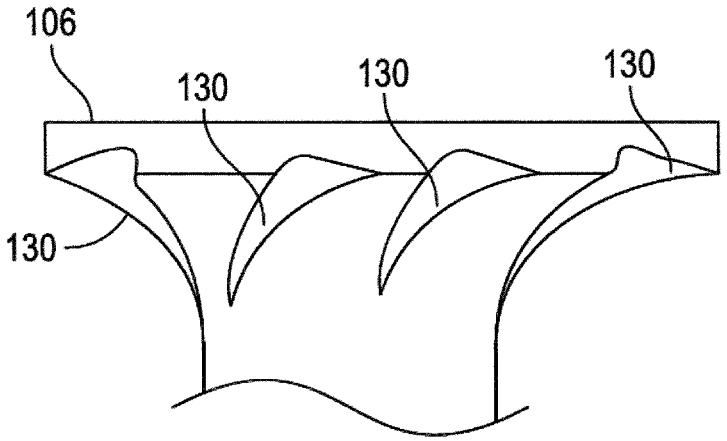
FIG. 3 is an enlarged elevational view of the vanes.

With reference to FIGS. 2 and 3, the vanes 130 at one end portion are circumferentially spaced apart and form channels 140 therebetween. In one preferred embodiment, the vanes 130 are spaced apart and terminate adjacent every second row of bristles 122. The vanes 130 preferably vary in radial height from the outer surface 124 of the brush head 104 over an axial dimension. The radial height of the vanes 130 decreases as the vanes 130 extend axially toward the central portion 110 of the brush head 104 and the vanes 130 merge into the outer surface 124 of the brush head 104 (merging into the outer surface of the central portion of the brush head adjacent an end of a row of bristles). In one preferred embodiment, the vanes 130 are configured to direct air flow along the brush head 104 between adjacent rows of bristles 122. The vanes 130 terminate in an axial direction adjacent the rows of bristles 122. This allows the vanes to act as a channeling component. In another preferred embodiment, the vanes 130 are fixed on the brush head 104 and continue into the space between the rows of bristles 122. The vanes 130 may be deeper on one side. The vanes are configured to redirect airflow from an associated hair dryer through channels 140 between the rows of bristles 122. The channels 140 may be simply formed as the space defined on the outer surface of the hairbrush central portion between the rows of bristles, and/or may include cuts or grooves formed in the outer surface between the rows of bristles which assist in air flow therethrough. The channeling of air flow continues through the length of the barrel of brush head 104, for example between a second set of vanes provided at the other end portion of the hairbrush.

Figure 4:
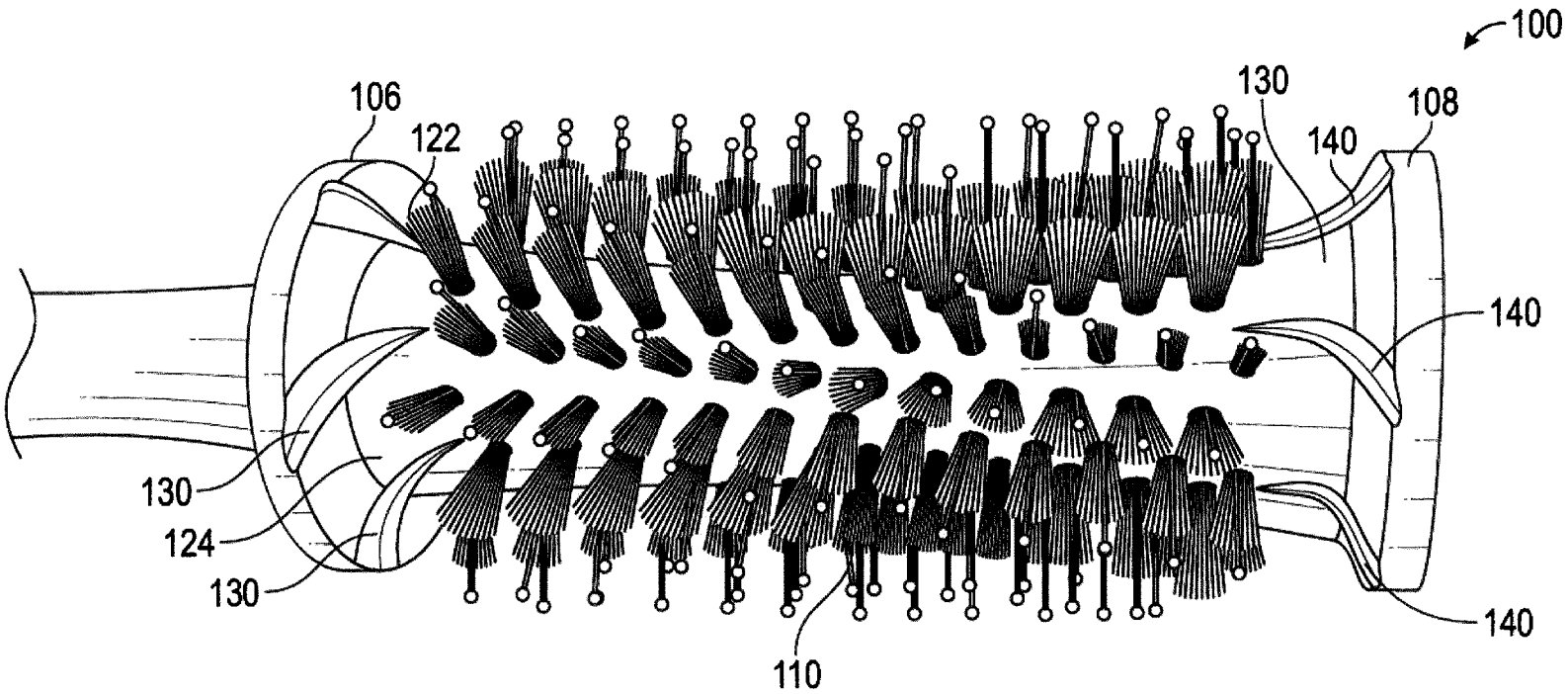
FIG. 4 is a front view of the hairbrush in accordance with the present disclosure channeling the air for a left-handed user/stylist.

With reference to FIG. 4, the vanes 130 extend radially outward from the second end portion 108 for directing air flow from an associated hair dryer impinging on the hairbrush 100 in an axial direction along the central portion 110 toward the first enlarged end portion 106 of the brush head, the vanes 130 located on the first enlarged end 106 portion terminate adjacent an end of a first set of bristle rows 122. The vanes 130 located on the second enlarged end portion 108 terminate adjacent an end of a second set of bristle rows. The first set of bristle rows alternate with the second set of bristle rows about a circumference of the central portion 110 of the brush head 104.

In another arrangement, the vanes 130 located on the first enlarged end portion 106 terminate adjacent an end of a first set of bristle rows 122 and the vanes 130 located on the second enlarged end portion 108 terminate adjacent an end of a first set of bristle rows 122 about a circumference of the central portion 110 of the brush head 104.

Figure 6:
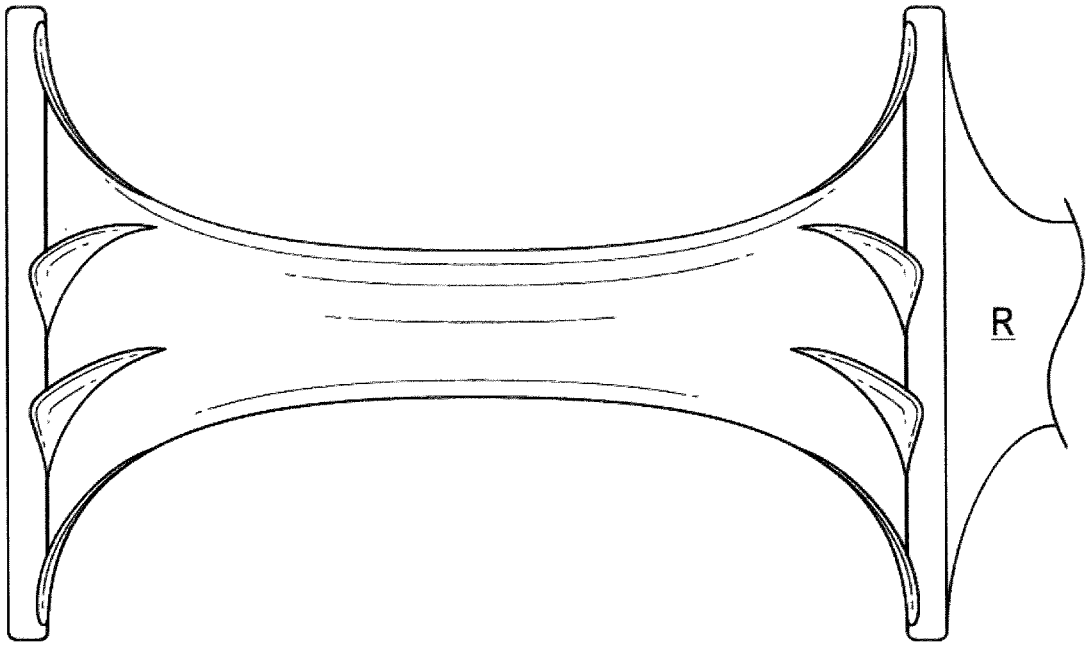
FIG. 6 is a front view of the hairbrush head configured for a right-handed user/stylist.
Figure 7:
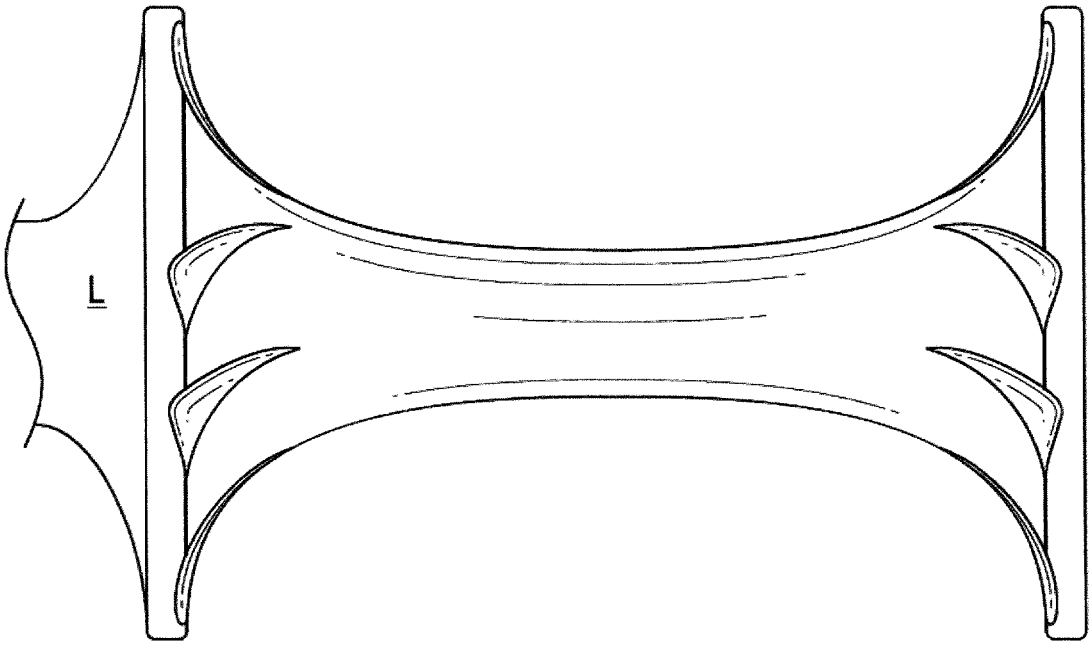
FIG. 7 is a front view of the hairbrush head configured for a left-handed user/stylist.

The hairbrush 100 is an interactive tool designed to be used by a left-handed or right-handed user or stylist. The hairbrush 100 can be configured for either a dominant right-handed user (FIG. 6) or configured differently for a dominant left-handed user (FIG. 7). The vanes 130 create a styling hairbrush 100 that becomes interactive and has the ability to control air flow and heat by redirecting both to the center of the brush head 104 above and below the hair section. The structure of the inventive hairbrush 100 as described above enhances both heat and air flow above and below the hair section while reducing drying time and heat damage to the hair. When using a typical hairbrush with a hair dryer or hair blower, for example, air flow directed toward a conventional hairbrush reflects or bounces in all directions, whereas the present invention provides directional control of the airflow as a result of providing the enlarged or captive end(s) 106, 108 and the preferred shape of the generally concave conformation of the central portion 110 in conjunction with the vanes 130. The vanes 130 provide additional directional control that advantageously speeds up the drying time and directs air below (adjacent the base of the bristles and the external surface of the hairbrush body) and above the hair supported on the ends of the bristles. The vanes aid in directing the air flow along paths or channels formed between the bristles. Still further, with the present invention the hairbrush can be tailored for use as a specific right-hand brush or a specific left-hand brush. These features—both individually and collectively—are a significant improvement over existing, traditional styling hairbrushes that disperse both the air and heat in all directions without the efficient control and structure as are achieved with the hairbrush 100 having the vanes 130. Prior to the present hairbrush with the vanes 130 specifically configured for either a right-handed or a left-handed user/stylist, the same conventional hairbrush was used by either right-handed or left-handed users. Such traditional hairbrushes did nothing to enhance the styling process, and instead were simply a core with bristles with different diameters, and were nonactive during the styling process other than when a user/stylist shapes or smooths hair by manipulating the hairbrush.

Figure 5:
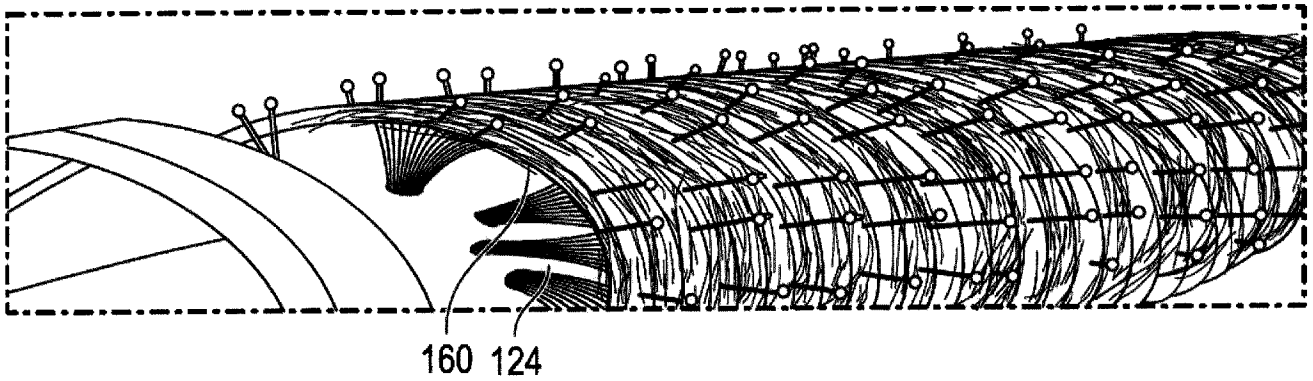
FIG. 5 is a view taken generally from one end of the hairbrush showing a user's hair "floating" on a cushion of bristles.

Another aspect of the present invention is to provide a hairbrush with more styling features and heat protection features. FIGS. 4 and 5 show hairbrush 100 that includes handle 102, a brush head 104 connected to the handle 102, bristles 122 extending from the outer surface 124 of the brush head 104, rows of bristles 122, and vanes 130. A user's hair 160 is supported on top of a "cushion" of bristles without coming into contact with the brush head 104. The vanes 130 direct air flow from the associated hair dryer along the brush head 104 underneath the user's hair 160. This enhances the ability to control/style the hair with this hairbrush when compared to prior hairbrush designs. These structural and functional features channel more air flow beneath the central portion of the hairbrush. Another advantage of this is it greatly reduces the drying time and without damaging the user's hair. Because the hair 160 floats on a cushion of bristles, the user's hair has a reduced chance of contacting the hot surface of the hairbrush 100. This also reduces the damage to a user's hair normally caused by heat. The vanes at each end work in conjunction with the enlarged "captive ends" (i.e., the larger diameter enlarged end portions that are greater in cross-sectional dimension than the narrower central portion of the hairbrush) to channel the air flow from the hair dryer into each end of the hairbrush, into the channels formed between the rows of bristles, and beneath the hair supported on the bristle ends. This allows that section of hair supported by the bristles of the hairbrush to have increased air flow beneath the hair (i.e., radially pass between the outer surface of the brush head and the hair supported on the outer ends of the bristles) during styling so that the hair dries from above and below. This speeds up the drying time without damage to the hair. Again, this arrangement limits direct contact of the hair with the hot surface of the brush head which could lead to hair damage. Further, the thermal conductive technology shown and described in U.S. Pat. No. 10,2922,486 can be used in this hairbrush to provide further temperature control that limits hair damage. The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. A hairbrush comprising: a handle; a round brush head connected to the handle having first and second axially spaced apart end portions interconnected by a central portion along an elongated axis; bristles extending from an outer surface of the brush head and the bristles having terminal ends spaced radially outward from the outer surface; and vanes extending radially outward from the first end portion of the brush head configured to direct air flow from an associated hair dryer impinging on the hairbrush in an axial direction along the central portion toward the second end portion of the brush head; wherein the vanes are circumferentially spaced apart and form channels therebetween; wherein the vanes vary in radial height from the outer surface of the brush head over an axial dimension; and, wherein the radial height of the vanes decreases as the vanes extend axially toward the central portion of the brush head and the vanes merge into the outer surface of the brush head.

2. The hairbrush of claim 1, further comprising vanes extending radially outward from the second end portion of the brush head configured to direct air flow from the associated hair dryer impinging on the hairbrush in an axial direction along the central portion toward the first end portion of the brush head.

3. The hairbrush of claim 1, wherein the central portion of the brush head has a cross-sectional first dimension smaller than a cross-sectional second dimension of the first end portion.

4. The hairbrush of claim 1, wherein the central portion of the brush head has a cross-sectional first dimension smaller than a cross-sectional second dimension of the first end portion and a cross-sectional third dimension of the second end portion.

5. The brush head of claim 4, wherein the second and third dimensions of the first and second end portions are substantially the same.

6. The hairbrush of claim 1, wherein the bristles include bundles of individual bristles tightly bunched together at the outer surface of the brush head and the individual bristles diverge outwardly from one another as the bristles extend radially outward from the outer surface of the brush head.

7. The hairbrush of claim 1, wherein the handle is connected to the first end portion of the brush head.

8. The hairbrush of claim 1, wherein the handle is connected to the second end portion of the brush head.

9. The hairbrush of claim 1, wherein the brush head has a concave conformation.

10. The hairbrush of claim 1, wherein the brush head includes arcuate transitions from the first and second end portions into the central portion of the brush head.

11. The hairbrush of claim 1, wherein the handle and the brush head are formed at least in part from different materials.

12. The hairbrush of claim 1, wherein the hairbrush head includes a substrate formed from one of wood, metal, or a plastic composition.

13. The hairbrush of claim 1, wherein the vanes are configured for a transposable grip of the brush head.

14. A hairbrush comprising: a handle; a round brush head connected to the handle having first and second axially spaced apart end portions interconnected by a central portion along an elongated axis; bristles extending from an outer surface of the brush head and the bristles having terminal ends spaced radially outward from the outer surface; and vanes extending radially outward from the first end portion of the brush head configured to direct air flow from an associated hair dryer impinging on the hairbrush in an axial direction along the central portion toward the second end portion of the brush head; wherein the bristles extend from the central portion only, and the bristles are arranged in circumferentially spaced rows extending axially from the first end portion to the second end portion of the brush head;

and, wherein the vanes terminate in an axial direction adjacent the rows of bristles and merge into the outer surface of the brush head.

15. The hairbrush of claim 14, wherein the vanes are configured to direct air flow along the brush head between the rows of bristles.

16. A hairbrush comprising: a handle; a round brush head connected to the handle having first and second axially spaced apart end portions interconnected by a central portion along an elongated axis: bristles extending from an outer surface of the brush head and the bristles having terminal ends spaced radially outward from the outer surface; and vanes extending radially outward from the first end portion of the brush head configured to direct air flow from an associated hair dryer impinging on the hairbrush in an axial direction along the central portion toward the second end portion of the brush head; wherein the bristles extend from the central portion only, and the bristles are arranged in circumferentially spaced rows extending axially from the first end portion to the second end portion of the brush head; wherein alternating rows of the bristles have staggered axial dimensions along the central portion of the brush head; and, further comprising vanes extending radially outward from the second end portion for directing air flow from the associated hair dryer impinging on the hairbrush in an axial direction along the central portion toward the first end portion of the brush head, the vanes located on the first end portion terminate adjacent an end of a first set of bristle rows, and the vanes located on the second end portion terminate adjacent an end of a second set of bristle rows, wherein the first set of bristle rows alternate with the second set of bristle rows about a circumference of the central portion of the brush head.

* * * * *